US007857433B2

(12) United States Patent
Chung et al.

(10) Patent No.: US 7,857,433 B2
(45) Date of Patent: Dec. 28, 2010

(54) INKJET PRINTHEAD EMPLOYING PIEZOELECTRIC ACTUATOR AND METHOD OF MANUFACTURING THE INKJET PRINTHEAD

(75) Inventors: Jae-woo Chung, Yongin-si (KR); Hwa-sun Lee, Suwon-si (KR); Ji-hoon Kim, Seoul (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 609 days.

(21) Appl. No.: 11/471,487

(22) Filed: Jun. 21, 2006

(65) Prior Publication Data

US 2007/0176979 A1 Aug. 2, 2007

(30) Foreign Application Priority Data

Feb. 2, 2006 (KR) ..... 10-2006-0010055

(51) Int. Cl.
*B41J 2/045* (2006.01)

(52) U.S. Cl. ..... 347/70

(58) Field of Classification Search ..... 347/70, 347/72, 75, 68, 67
See application file for complete search history.

(56) References Cited

U.S. PATENT DOCUMENTS 5,489,967 A * 2/1996 Sakagami et al. ..... 399/1
5,541,630 A * 7/1996 Ema et al. ..... 347/70
5,767,612 A * 6/1998 Takeuchi et al. ..... 310/324
6,357,866 B1 * 3/2002 van Rensburg ..... 347/75
6,369,489 B1 * 4/2002 Sawai et al. ..... 310/326
7,316,470 B2 * 1/2008 Nishi et al. ..... 347/69
2005/0140743 A1 * 6/2005 Miyazawa et al. ..... 347/68
2006/0012647 A1 1/2006 Yamada et al.

FOREIGN PATENT DOCUMENTS

| | | |
|---|---|---|
| EP | 1640163 | 3/2006 |
| JP | 2000-028920 | 1/2000 |
| JP | 2000-289201 | 10/2000 |

OTHER PUBLICATIONS

European Search Report dated May 16, 2007 issued in EP 06252594.4.
Chinese Office Action issued Sep. 11, 2009 in CN Application No. 2006100943608.

* cited by examiner

*Primary Examiner*—Stephen D Meier
*Assistant Examiner*—Alexander C Witkowski
(74) *Attorney, Agent, or Firm*—Stanzione & Kim, LLP

(57) ABSTRACT

A piezoelectric inkjet printhead includes a fluid path forming substrate having a pressure chamber, a piezoelectric actuator formed on the fluid path forming substrate to provide a drive force to the pressure chamber to eject ink, and a damping layer formed on the piezoelectric actuator to dampen a residual vibration of the piezoelectric actuator.

6 Claims, 7 Drawing Sheets

INKJET PRINTHEAD EMPLOYING PIEZOELECTRIC ACTUATOR AND METHOD OF MANUFACTURING THE INKJET PRINTHEAD

CROSS-REFERENCE TO RELATED APPLICATIONS

This application claims priority under 35 U.S.C. §119(a) from Korean Patent Application No. 10-2006-0010055, filed on Feb. 2, 2006, in the Korean Intellectual Property Office, the disclosure of which is incorporated herein in its entirety by reference.

BACKGROUND OF THE INVENTION

1. Field of the Invention

The present general inventive concept relates to an inkjet printhead, and more particularly, to an inkjet printhead to eject ink using a piezoelectric method, and a method of manufacturing the inkjet printhead.

2. Description of the Related Art

In general, an inkjet printhead prints a predetermined color image by ejecting fine droplets of printing ink to a desired position on a print paper. The inkjet printhead can be classified into two types according to an ink ejection method: a thermal inkjet printhead and a piezoelectric inkjet printhead. The thermal inkjet printhead generates a bubble in ink using a heat source to eject the ink using an extension force of the bubble. The piezoelectric inkjet printhead uses a piezoelectric material to eject ink using a pressure applied to the ink which is generated by a deformation of a piezoelectric material.

FIG. 1 is a cross-sectional view illustrating a configuration of a conventional piezoelectric inkjet printhead. Referring to FIG. 1, a fluid path forming substrate 10 includes a manifold 13 forming a path for ink, a plurality of restrictors 12, and a plurality of pressure chambers 11. A nozzle substrate 20 includes a plurality of nozzles 22 respectively corresponding to the pressure chambers 11. A piezoelectric actuator 40 is provided in an upper portion of the fluid path forming substrate 10. The manifold 13 is a path through which ink supplied from an ink reservoir is provided to each of the pressure chambers 11. The restrictor 12 is a path through which the ink passes from the manifold 13 into each of the pressure chamber 11. The pressure chambers 11 are filled with the ink to be ejected and arranged at one side or both sides of the manifold 13. The pressure chambers 11 generate a change in pressure to eject ink out of the pressure chambers 11 or to suck the ink into the pressure chambers 11 as a pressure of the pressure chambers 11 and a volume of the ink vary according to an operation of the piezoelectric actuator 40. To this end, a portion forming an upper wall of the pressure chambers 11 of the fluid path forming substrate 10 functions as a vibration plate 14 which is deformed by the piezoelectric actuator 40.

The piezoelectric actuator 40 includes a lower electrode 41, a piezoelectric layer 42, and an upper electrode 43, which are sequentially deposited on the fluid path forming substrate 10. A silicon oxide layer 31 is formed between the lower electrode 41 and the fluid path forming substrate 10 as an insulating layer. The lower electrode 41 is formed over an entire surface of the silicon oxide layer 31 to function as a common electrode. The piezoelectric layer 42 is formed on the lower electrode 41 on an area corresponding to a location of the pressure chambers 11. The upper electrode 43 is formed on the piezoelectric layer 42 and functions as a drive electrode to apply a voltage to the piezoelectric layer 42. A flexible printed circuit 50 for supplying the voltage to the upper electrode 43 is connected to the upper electrode 43.

When a drive pulse is applied to the upper electrode 43, the piezoelectric layer 42 is deformed and the vibration plate 14 is deformed so that the volume of each of the pressure chambers 11 is changed. Thus, the ink in the pressure chambers 11 is ejected through the nozzles 22. A frequency of the drive pulse is affected by a damping performance of the piezoelectric layer 42. Therefore, a vibration of the piezoelectric layer 42 needs to be quickly dampened.

FIG. 2 is a graph illustrating a residual vibration of the conventional piezoelectric inkjet printhead of FIG. 1. Specifically, FIG. 2 illustrates a result a displacement of the piezoelectric layer 42 of FIG. 1, using laser-dopier velocimetry (LDV), after a drive pulse is applied to the upper electrode 43. Referring to FIG. 2, the displacement of the piezoelectric layer 42 to eject the ink is generated for about 15 μs and then a residual vibration of the piezoelectric layer 42 continues for about 85 μs. According to the result illustrated in FIG. 2, when a frequency of the drive pulse is greater than 10 KHz, the displacement of the piezoelectric layer 42 in a subsequent cycle is affected by the residual vibration caused by the drive pulse of the preceding cycle. As a result, it is difficult to eject ink droplets at a constant speed and a volume of the ejected ink droplets may be irregular. Also, since a pressure wave in each of the pressure chambers 11 is not removed within a short time, cross-talk can be generated between adjacent pressure chambers 11.

SUMMARY OF THE INVENTION

The present general inventive concept provides a piezoelectric inkjet printhead which can quickly dampen a residual vibration of a piezoelectric layer, and a method of manufacturing the piezoelectric inkjet printhead.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing a piezoelectric inkjet printhead, including a fluid path forming substrate having a pressure chamber, a piezoelectric actuator formed on the fluid path forming substrate to provide a drive force to the pressure chamber to eject ink therefrom, and a damping layer formed on the piezoelectric actuator to dampen a residual vibration of the piezoelectric actuator.

The damping layer may be formed on an upper portion of the fluid path forming substrate corresponding to a location of the pressure chamber.

The piezoelectric inkjet printhead may further include a printed circuit to apply a drive voltage to drive the piezoelectric actuator, and the damping layer may be formed on a conjunction portion between the printed circuit and the piezoelectric actuator.

A mechanical loss rate of the damping layer may be larger than a mechanical loss rate of the piezoelectric actuator and a mechanical loss rate of the fluid path forming substrate. A Young's modulus of the damping layer may be not more than about 5,000 MPa.

The damping layer may be formed of a compound selected from the group consisting of silicon rubber, an epoxy, polyurethane, a photoresist substance, and combinations thereof.

The foregoing and/or other aspects and utilities of the present general inventive concept may also be achieved by providing a piezoelectric inkjet printhead, including a fluid path forming substrate having a pressure chamber, a piezoelectric actuator to provide a drive force to the pressure chamber to eject ink, and a damping layer formed on the piezoelectric actuator, the damping layer having a mechanical loss rate that is larger than a mechanical loss rate of the piezoelectric actuator and a mechanical loss rate of the fluid path forming substrate.

The foregoing and/or other aspects and utilities of the present general inventive concept may also be achieved by providing a piezoelectric inkjet printhead, including a substrate forming a pressure chamber, a piezoelectric actuator formed on a surface of the substrate to provide an ink ejecting pressure in the pressure chamber, and a predetermined material formed on the piezoelectric actuator to compensate for residual vibrations generated by an operation of the piezoelectric actuator.

The predetermined material may include at least one member selected from the group consisting of silicon rubber, an epoxy, polyurethane, a photoresist substance, and combinations thereof. The predetermined material may have a Young's modulus of less than or equal to about 5,000 MPa. The piezoelectric inkjet printhead may further include a nozzle layer formed on a second surface of the substrate to eject ink from the pressure chamber onto a printing medium.

An elastic coefficient of the predetermined material may be smaller than an elastic coefficient of at least one of the piezoelectric actuator and the substrate. The elastic coefficient of the predetermined material may be about 30 to about 400 times smaller than the elastic coefficient of the substrate. The elastic coefficient of the predetermined material may be about 8 to about 120 times smaller than the elastic coefficient of the piezoelectric actuator. The elastic coefficient of the predetermined material may be less than or equal to about 5 KPa, the elastic coefficient of the piezoelectric actuator may be about 40 to about 600 KPa, and the elastic coefficient of the substrate may be about 150 to about 2000 KPa.

A mechanical loss rate of the predetermined material may be greater than a mechanical loss rate of at least one of the piezoelectric actuator and the substrate. The piezoelectric inkjet printhead may further include an insulating layer formed between the fluid path forming substrate and the piezoelectric actuator. The substrate may be a silicon wafer, and the insulating layer is a silicon oxide layer.

The predetermined material may include a plurality of materials. The predetermined material may be formed over the piezoelectric actuator and at least a portion of the substrate. The predetermined material may be formed over an entire portion of the substrate corresponding to a location of the pressure chamber. The predetermined material may absorb the residual vibrations generated by the operation of the piezoelectric actuator. The predetermined material may be formed on the piezoelectric actuator as a coating having a predetermined thickness.

The foregoing and/or other aspects and utilities of the present general inventive concept may also be achieved by providing a method of manufacturing a piezoelectric inkjet printhead, including forming a pressure chamber within a substrate, forming a piezoelectric actuator on a surface of the substrate corresponding to the pressure chamber to provide an ink ejecting pressure in the pressure chamber, and forming a predetermined material on the piezoelectric actuator to compensate for residual vibrations of the piezoelectric actuator.

The method may further include forming a nozzle layer on a second surface of the substrate to eject ink from the pressure chamber onto a printing medium. The forming of the predetermined material on the piezoelectric actuator may include coating the predetermined material over the piezoelectric actuator.

The foregoing and/or other aspects and utilities of the present general inventive concept may also be achieved by providing a method of damping a residual vibration of a piezoelectric inkjet printhead having a substrate and a piezoelectric actuator, the method including compensating for a residual vibration generated by the piezoelectric actuator using a predetermined material having an elastic coefficient that is smaller than an elastic coefficient of at least one of the piezoelectric actuator and the substrate.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
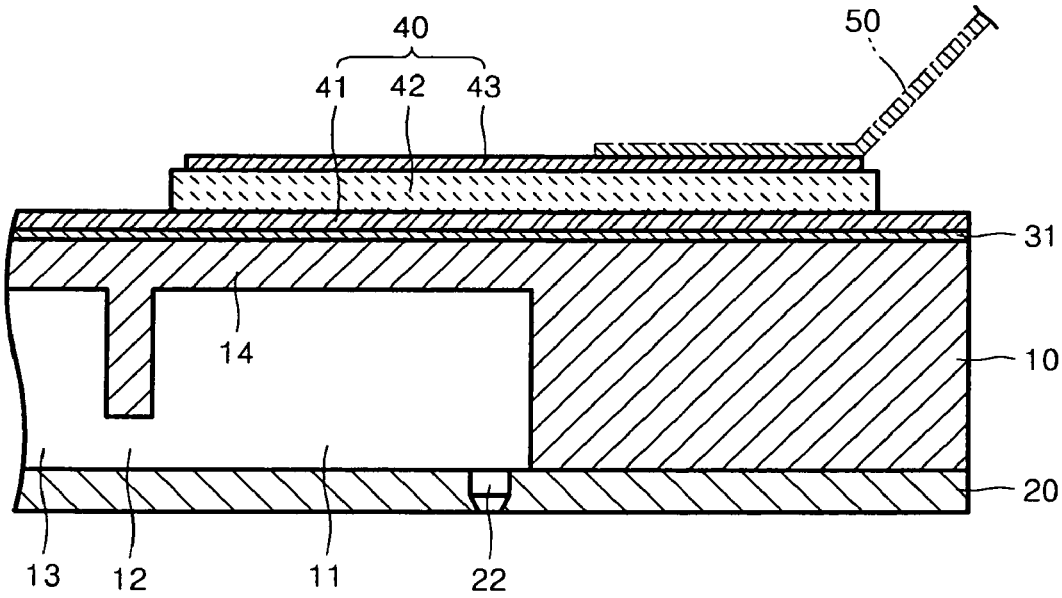
FIG. 1 (PRIOR ART)
FIG. 1 is a cross-sectional view illustrating a configuration of a conventional piezoelectric inkjet printhead.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures. A size of each constituent element in the drawings may be exaggerated for a convenience of explanation. Also, where a layer is described to exist on another layer, the layer can exist while directly contacting the other layer or a third layer can exist therebetween.

Figure 3:
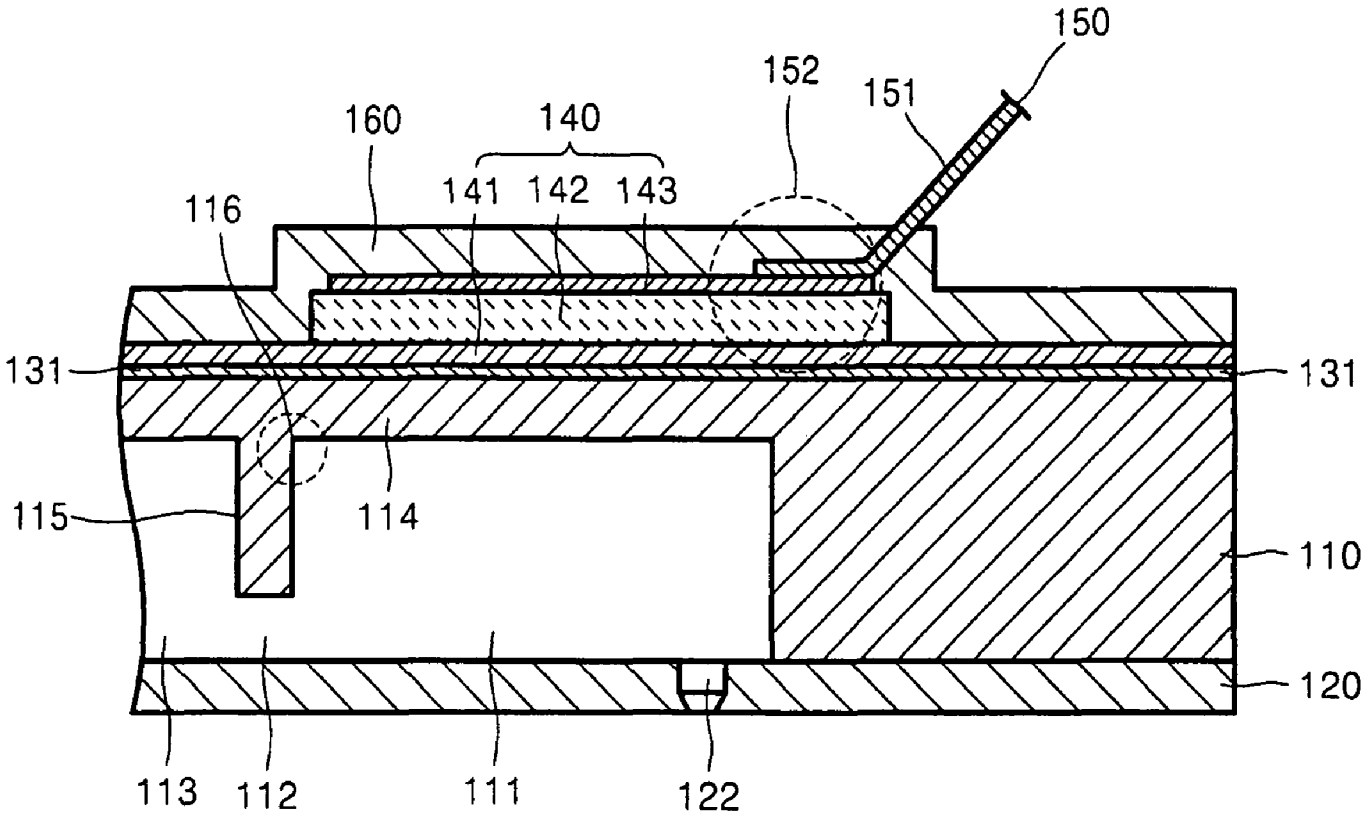
FIG. 3 is a cross-sectional view illustrating a configuration of an inkjet printhead, according to an embodiment of the present general inventive concept.
Figure 4:
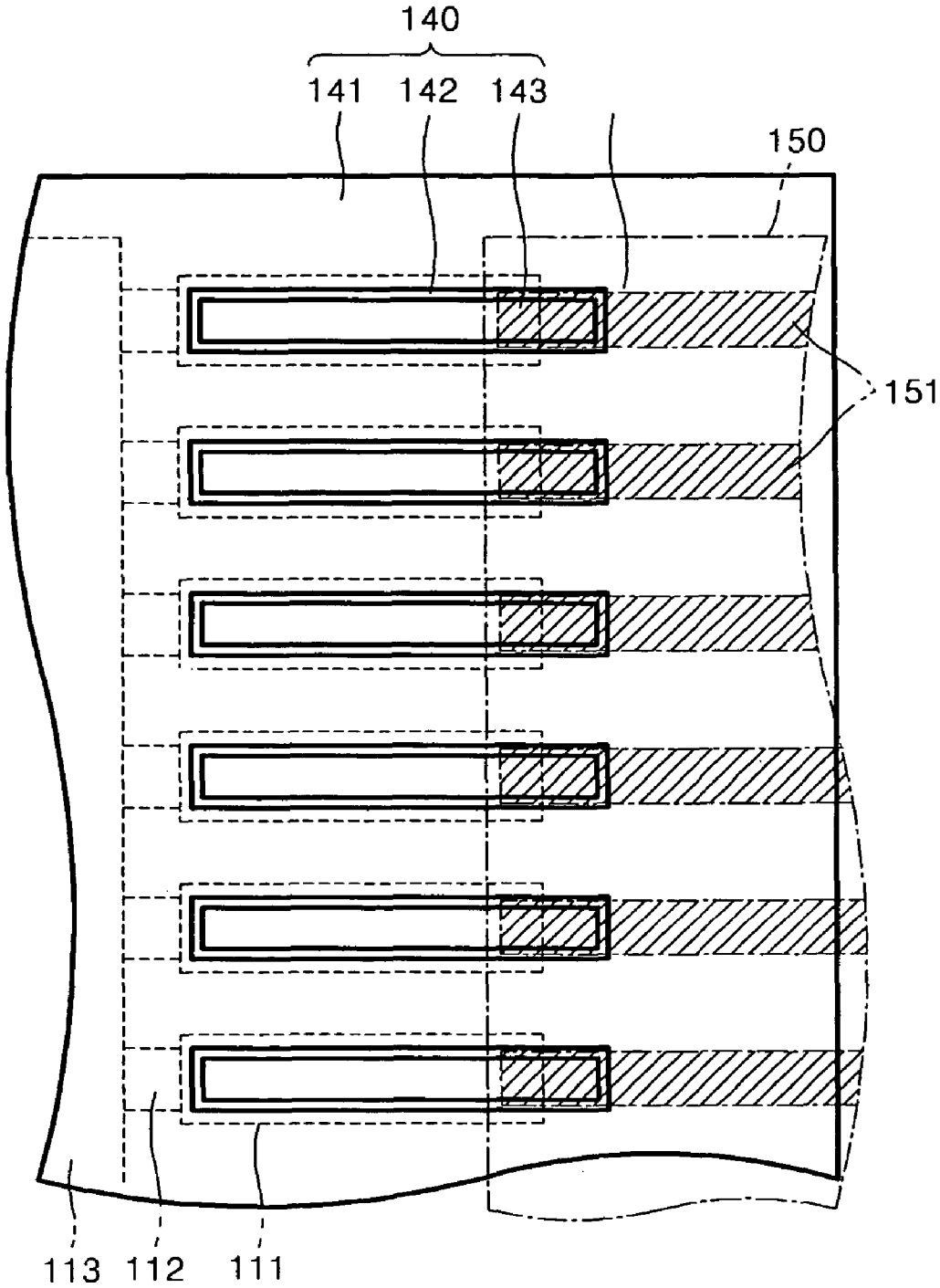
FIG. 4 is a plan view illustrating the inkjet printhead of FIG. 3.

FIG. 3 is a cross-sectional view illustrating a configuration of an inkjet printhead, according to an embodiment of the present general inventive concept. FIG. 4 is a plan view illustrating the inkjet printhead of FIG. 3. Referring to FIGS. 3 and 4, an inkjet printhead according to an embodiment of the present general inventive concept includes a fluid path forming substrate 110 to form an ink path and a piezoelectric actuator 140 to provide an ink ejection pressure. The fluid path forming substrate 110 includes a pressure chamber 111, a manifold 113 to supply ink into the pressure chamber 111, and a restrictor 112. A nozzle 122 to eject the ink from the ink chamber 111 is formed in a nozzle substrate 120, which is attached to the fluid path forming substrate 110. A vibration plate 114 is provided on the pressure chamber 111 and is deformable by an operation of the piezoelectric actuator 140. The ink path is defined by the fluid path forming substrate 110 and the nozzle substrate 120.

The piezoelectric actuator 140 is formed on the fluid path forming substrate 110 and provides a drive force to eject the ink from the pressure chamber 111. The piezoelectric actuator 140 includes a lower electrode 141 to function as a common electrode, a piezoelectric layer 142 that is deformable by an application of a voltage thereto, and an upper electrode 143 to function as a drive electrode. The lower electrode 141, the piezoelectric layer 142, and the upper electrode 143 can be sequentially deposited on the fluid path forming substrate 110.

The lower electrode 141 is formed on the fluid path forming substrate 110 at a position corresponding to a position of the pressure chamber 111. When the fluid path forming substrate 110 is formed of a silicon wafer, a silicon oxide layer 131 can be formed between the fluid path forming substrate 110 and the lower electrode 141 as an insulating layer. The lower electrode 141 is formed of a conductive metal material. The lower electrode 141 can be a single metal layer, or can be two metal layers formed of, for example, a Ti layer and a Pt layer. The lower electrode 141 made of Ti/Pt layers not only functions as the common electrode but also as a diffusion barrier layer to prevent inter-diffusion between the piezoelectric layer 142 and the fluid path forming substrate 110, which are respectively formed on and below the lower electrode 141.

The piezoelectric layer 142 is formed on the lower electrode 141 and is arranged at a position corresponding to the position of the pressure chamber 111. The piezoelectric layer 142 can be formed of a piezoelectric material, such as a PZT (lead zirconate titanate) ceramic material. The upper electrode 143 functions as the drive electrode to apply a voltage to the piezoelectric layer 142. A wiring 151 of a voltage application drive circuit, for example, a flexible printed circuit 150, can be bonded to an upper surface of the upper electrode 143.

The fluid path forming substrate 110, the nozzle substrate 120, and the piezoelectric actuator 140 illustrated in FIGS. 3 and 4 are merely examples. Thus, an ink path having a variety of structures can be provided in the piezoelectric inkjet printhead and the ink path can be formed using a plurality of substrates, i.e., more than the two substrates 110 and 120 illustrated in FIG. 3. Also, the piezoelectric actuator 140 and a connecting structure to connect the piezoelectric actuator 140 and the voltage application drive circuit can be modified in a variety of additional ways, different from the conjunction portion 152 illustrated in FIGS. 3 and 4.

A vibration of the piezoelectric layer 142 should be quickly dampened. To this end, an active damping method, a passive damping method, and a method using a bulk actuator can be taken into consideration.

Figure 2:
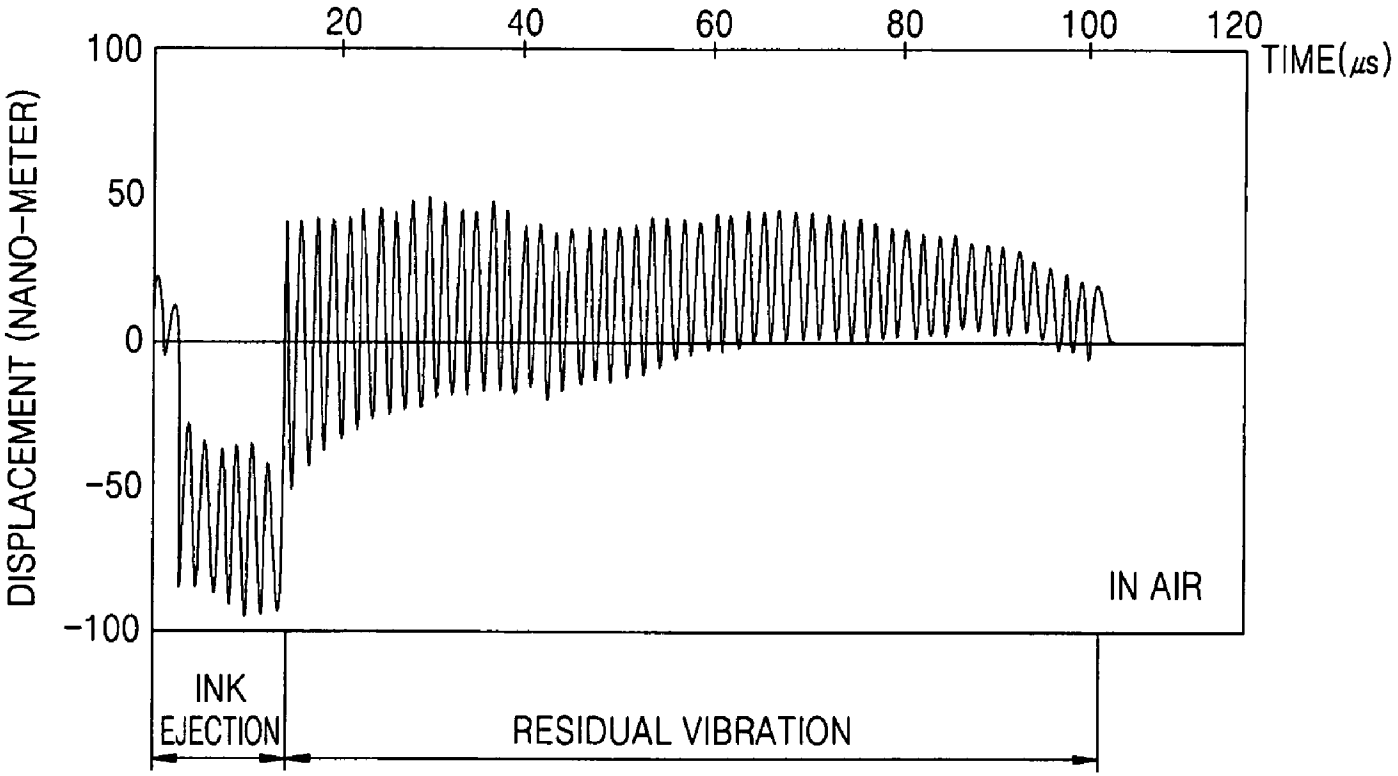
FIG. 2 (PRIOR ART)
FIG. 2 is a graph illustrating a residual vibration of the conventional piezoelectric inkjet printhead of FIG. 1.

The active damping method forcibly dampens a residual vibration by applying an auxiliary pulse following a main drive pulse to eject ink to generate in the piezoelectric layer 142 a vibration opposite to a residual vibration wave of the piezoelectric layer 142. For example, the auxiliary pulse may be applied during a time period between 15 μs and 100 μs in the graph of FIG. 2. According to this method, although quick damping is possible, a structure of a drive circuit to drive the piezoelectric actuator 140 is complicated. Also, a time point to apply the auxiliary pulse should be carefully selected.

The passive damping method adds a material having a large mechanical loss rate to a vibrating material so that the passive damping material absorbs or consumes residual vibration energy.

The bulk actuator refers to a piezoelectric actuator manufactured by etching a sintered piezoelectric material. Since a density of the sintered piezoelectric material is high and a thickness thereof is large, a stiffness thereof is great. Thus, the bulk actuator is effective in damping residual vibration. However, a manufacturing process of the bulk actuator is complicated and a yield is low. Also, since a displacement of the bulk actuator is relatively small, a high drive voltage is required.

Referring to FIG. 3, a damping layer 160 is formed on the piezoelectric actuator 140 in the piezoelectric inkjet printhead according to the present embodiment. A mechanical loss rate of the damping layer 160 may be greater than that of the piezoelectric actuator 140, the piezoelectric layer 142, and/or the fluid path forming substrate 110. The mechanical loss rate of a material can be expressed in a variety of ways, such as a Young's modulus (i.e., elastic coefficient) of the material and a loss coefficient of the material in a shear mode (where the loss coefficient is a tangent value of an imaginary number portion divided by a real number portion of a shear modulus "G"). Hereinafter, mechanical loss rates of the damping layer 160, the piezoelectric actuator 140, the piezoelectric layer 142, and the fluid path forming substrate 110 are described using a Young's modulus for each of the damping layer 160, the piezoelectric actuator 140, the piezoelectric layer 142, and the fluid path forming substrate 110. As a Young's modulus of a material decreases, a mechanical loss rate of the material increases.

For example, a Young's modulus of a silicon mono-crystalline substrate, which can be used as the fluid path forming substrate 110, is about 150 to about 2,000 GPa. Also, PZT (lead zirconate titanate), which can be used to form the piezoelectric layer 142, has a Young's modulus of about 40 to about 600 GPa. The damping layer 160 should be soft enough so that the damping layer 160 does not restrict a small force and displacement generated by the piezoelectric actuator 140 to eject ink. Thus, a Young's modulus of the damping layer 160 should be smaller than that of the fluid path forming substrate 110, the piezoelectric actuator 140, and/or the piezoelectric layer 142. A Young's modulus of a material that can be employed as the damping layer 160 should not be more than about 5,000 MPa. The damping layer 160 can be formed of, for example, silicon rubber, such as any of RTV (room temperature volcanizing) silicon rubber, an epoxy, polyurethane, a photoresist material, and combinations thereof. The above-described materials are merely examples, and the damping layer 160 can be formed of a variety of materials having a Young's modules that is lower than that of the fluid path forming substrate 110 or the piezoelectric layer 142.

The damping layer 160 may cover at least the upper portion of the piezoelectric actuator 140. Furthermore, the damping layer 160 may cover an overall area of the fluid path forming substrate 110 corresponding to the pressure chamber 111. Also, the damping layer 160 can cover a conjunction portion 152 between the flexible printed circuit 150 and the piezoelectric actuator 140. When the damping layer 160 is formed by using a dispenser, by spin coating, or by spray coating, the damping layer 160 is formed over an overall upper portion of the print head, including the piezoelectric actuator 140. Moreover, although FIGS. 3 and 4 illustrate a single damping layer 160, the present general inventive concept is not so limited, and thus two or more damping layers 160 may be used.

Figure 5:
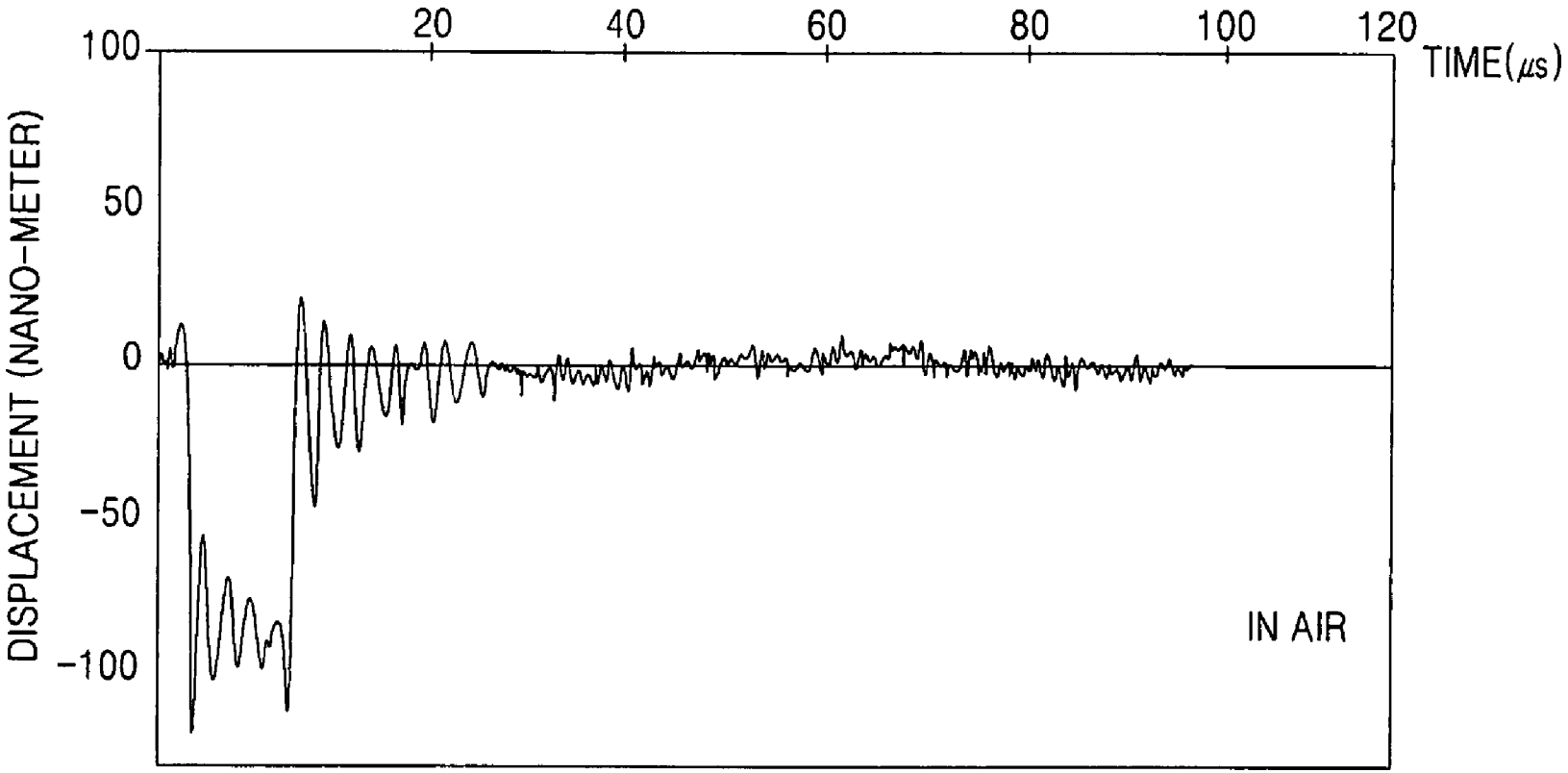
FIG. 5 is a graph illustrating a damping of a residual vibration of an embodiment of the inkjet printhead of FIG. 3.

FIG. 5 is a graph illustrating a damping of a residual vibration of an embodiment of the inkjet printhead of FIG. 3, the inkjet print head including the damping layer 160 formed of silicon rubber. A thickness of the damping layer 160 in this embodiment is about 2 mm, and an average elastic coefficient of the silicon rubber is about 5 MPa. A voltage of a drive pulse applied to the piezoelectric actuator 140 in this embodiment is 35 V and an application time of the drive pulse thereto is 10 μs.

Referring to FIG. 5, the residual vibration is almost completely dampened within about 35 μs after the drive pulse is applied to the piezoelectric actuator 140. Compared to a length of time for the residual vibration to be dampened in the conventional inkjet printhead (i.e., the damping time), illustrated in FIG. 2, a damping time of the residual vibration of the inkjet printhead according to this embodiment is substantially shorter, as illustrated in FIG. 5. Thus, an inkjet printhead according to embodiments of the present general inventive concept may reduce a damping time of a residual vibration by at least about three times as compared to a damping time of a residual vibration in a convention inkjet printhead. Although the thickness of the damping layer 160 in this embodiment is about 2 mm, the present general inventive concept is not limited thereto. In other words, although the inkjet printhead according to this embodiment, which has the damping time illustrated in FIG. 5, has a damping layer having a thickness of about 2 mm, various other embodiments of the present general inventive concept may have a damping layer having a thickness other than 2 mm. For example, inkjet printheads according to various embodiments of the present general inventive concept may have a thickness that is less than 2 mm or greater than 2 mm.

In order to stably eject ink having a high viscosity, there is a need to increase a displacement of the piezoelectric layer 142. The displacement of the piezoelectric layer 142 is substantially proportional to a size of the piezoelectric layer 142. Since the displacement of the piezoelectric layer 142 decreases when a thickness of the piezoelectric layer 142 increases, a relatively larger drive voltage is needed to obtain a desired displacement of a relatively thicker piezoelectric layer 142. A length of the piezoelectric layer 142 is dependent upon a length of the pressure chamber 111. Thus, to increase the size of the piezoelectric layer 142, a width of the piezoelectric layer 142 should be increased. When the thickness and length of the piezoelectric layer 142 are the same, and when only the width of the piezoelectric layer 142 is increased, a stiffness of the piezoelectric layer 142 decreases, which is disadvantageous to a restriction of a residual vibration. According to embodiments of the present general inventive concept, the damping layer 160 can compensate for the decrease in the stiffness of the piezoelectric layer 142 according to the increase of the width of the piezoelectric layer 142. Therefore, since the residual vibration can be effectively dampened while maintaining a high displacement of the piezoelectric layer 142, an inkjet printhead according to embodiments of the present general inventive concept is capable of stably ejecting ink having a high viscosity.

Since an auxiliary pulse used in active damping is not needed, a drive circuit can be simplified and a frequency of a drive pulse can be increased. Thus, an inkjet printhead according to embodiments of the present general inventive concept is capable of stable and high speed operation. Also, since a residual vibration can be quickly dampened, an ejection response characteristic with respect to the drive pulse can be improved. In addition, a movement stability of ink droplets can be maintained so that high quality printing can be obtained. Further, since cross-talk between adjacent pressure chambers is lowered, a speed and/or volume of ink droplets ejected from nozzles of an inkjet print head according to embodiments of the present general inventive concept can be uniformly maintained, thereby producing a uniform print quality.

Since the damping layer 160 is formed on an area of the fluid path forming substrate 110 corresponding to a location of the pressure chamber 111, a vibration transmitted to the entire fluid path forming substrate 110 by a pressure wave in the pressure chamber 111 can be absorbed by the damping layer 160. Additionally, the damping layer 160 can have a sealing function. For example, when a number of ejected ink droplets accumulates, micro-damage (for example, cracks) may occur in a corner portion 116 around a partition wall 115 extending to the restrictor 112 due to repeated vibrations of the vibration plate 114. When the ink leaks through the micro-damaged area (for example, the cracks), the upper and lower electrodes 143 and 141 may short-circuit so that a jetting reliability of an inkjet printhead may be decreased. However, this ink leakage can be prevented in an inkjet printhead according to embodiments of the present general inventive concept, since the damping layer 160 is formed on an area of the fluid path forming substrate 110 corresponding to a location of the pressure chamber 111.

Also, the damping layer 160 can function as an electric, mechanical, and/or chemical surface protection layer of the entire inkjet printhead, including the piezoelectric actuator 140. To maximize the sealing and surface protection functions, the damping layer 160 may be formed over the entire upper surface of the fluid path forming substrate 110, including the piezoelectric actuator 140. Also, since the damping layer 160 is formed to cover the conjunction portion 152 between the flexible printed circuit 150 and the piezoelectric actuator 140, a durability of the combination of the flexible printed circuit 150 and the piezoelectric actuator 140 can be improved.

Figure 6A:
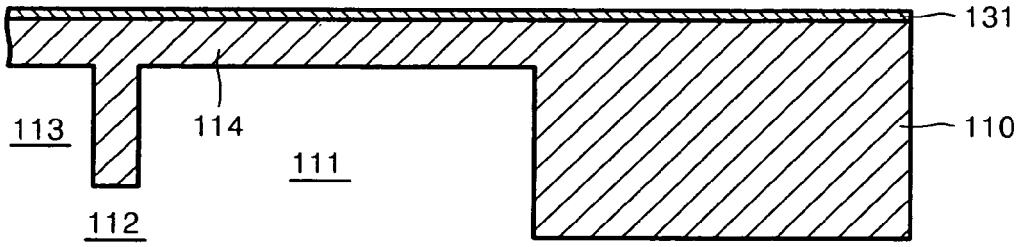
FIGS. 6A through 6D are cross-sectional views illustrating a method of manufacturing the inkjet printhead of FIG. 3, according to an embodiment of the present general inventive concept.

FIGS. 6A through 6D are cross-sectional views illustrating a method of manufacturing the piezoelectric inkjet printhead of FIG. 3, according to an embodiment of the present general inventive concept. Referring to FIG. 6A, the pressure chamber 111, the restrictor 112, the manifold 113, and the vibration plate 114 are formed in the fluid path forming substrate 110. The silicon oxide layer 131 is formed as an insulating layer on an upper surface of the fluid path forming substrate 110.

Figure 6B:
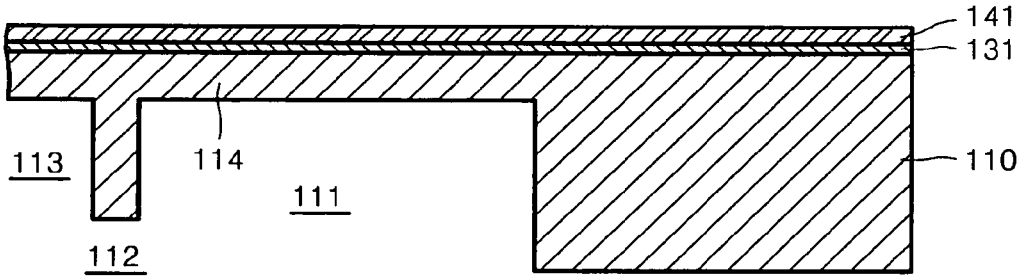

As illustrated in FIG. 6B, the lower electrode 141 is formed on the silicon oxide layer 131. For example, the lower electrode 141 can be formed of two metal layers, such as a Ti layer and a Pt layer. Furthermore, the lower electrode 141 can be formed to have a predetermined thickness by depositing the two metal layers, such as the Ti layer and the Pt layer, on an entire surface of the silicon oxide layer 131 by a deposition method.

Figure 6C:
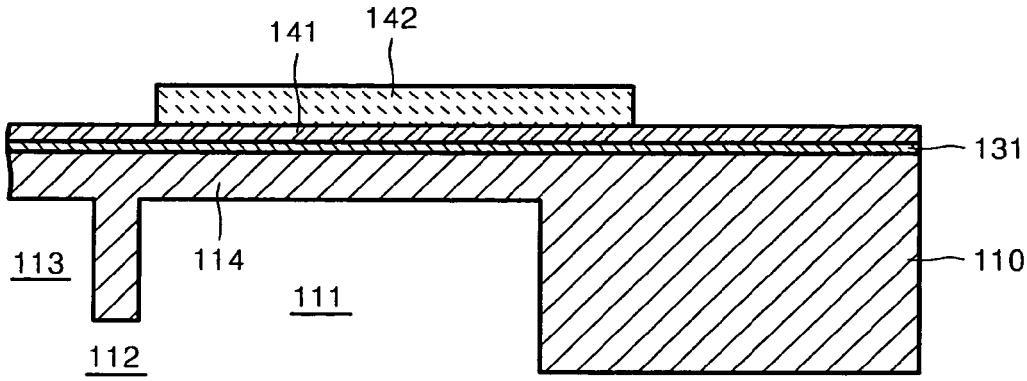

As illustrated in FIG. 6C, the piezoelectric layer 142 is formed by coating a piezoelectric material on the lower electrode 141. The piezoelectric layer 142 is formed to have a predetermined thickness by a patterning method, for example, a screen printing method. The piezoelectric layer 142 is formed at a position corresponding to a position of the pressure chamber 111. A variety of materials can be used as the piezoelectric material, such as a PZT (lead zircornate titanate) ceramic material.

Figure 6D:
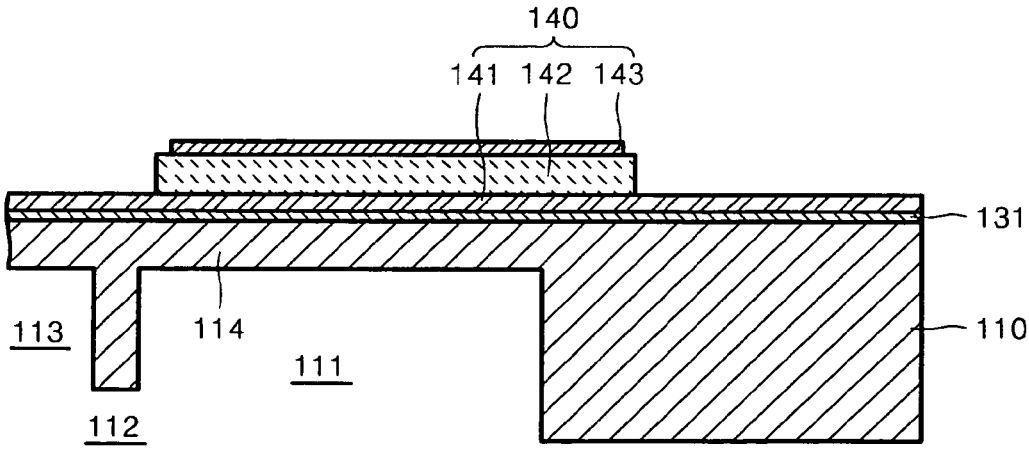

As illustrated in FIG. 6D, the upper electrode 143 is formed on the piezoelectric layer 142. The upper electrode 143 can be formed by, for example, screen printing a conductive metal material on the piezoelectric layer 142. After the piezoelectric layer 142 and the upper electrode 143 are sintered at a predetermined temperature, an electric field is applied to the piezoelectric layer 142 to perform a poling process to generate a piezoelectric characteristic.

Next, a damping material, such as silicon rubber or an epoxy, is coated on an upper portion of the piezoelectric actuator 140 using, for example, a dispenser, by spin coating, or by spray coating, to form the damping layer 160. The damping layer 160 is not formed on a position where the wiring 151 of the flexible printed circuit 150 is bonded, for example, by masking the upper electrode 143. Then, the voltage application drive circuit, for example, the wiring 151 of the flexible printed circuit 150, is bonded to an upper surface of the upper electrode 143 so that the piezoelectric inkjet printhead having the damping layer 160 as illustrated in FIG. 3 is manufactured.

The damping layer 160 can be formed in the above-described method after the wiring 151 of the flexible printed circuit 150 is bonded to the upper electrode 142. In this case, the damping layer 160 may be formed on the conjunction portion 152. Although not illustrated in FIGS. 6A-6D, the damping layer 160 can be formed by coating a damping material, such as silicon rubber or an epoxy, on a surface exposed after the inkjet printhead is packaged to a bezel (not illustrated) using, for example, a dispenser, by spin coating, or by spray coating. Moreover, although FIGS. 6A-6D illustrate forming a single damping layer 160, the present general inventive concept is not so limited, and thus two or more damping layers 160 may be formed.

As described above, in a piezoelectric inkjet printhead according to various embodiments of the present general inventive concept, since at least one damping layer is formed on an upper portion of a piezoelectric actuator, a damping time to dampen a residual vibration can be substantially reduced as compared to that of a conventional piezoelectric inkjet printhead. Thus, even when ink having a high viscosity is used, an inkjet printhead according to various embodiments of the present general inventive concept can stably eject ink. Also, a frequency of a drive pulse to drive the piezoelectric actuator can be increased so that the inkjet printhead is capable of a stable and high speed operation. Since an ejection response characteristic with respect to the drive pulse can be improved and a movement stability of an ink droplet can be secured, high quality printing can be obtained and cross-talk between adjacent pressure chambers can be reduced. Additionally, a sealing function to prevent leakage of ink and a function of firmly maintaining a connection between the piezoelectric actuator and a flexible printed circuit can be obtained.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A piezoelectric inkjet printhead, comprising:

a fluid path forming substrate having a pressure chamber;

a nozzle substrate attached to a first surface of the fluid path forming substrate and having a nozzle formed therein for ejecting ink from the pressure chamber;

a piezoelectric actuator having upper and lower electrodes and a piezoelectric layer disposed between the upper and lower electrodes, and formed on a second surface of the fluid path forming substrate to provide a drive force to the pressure chamber to eject ink, the second surface facing the first surface interposing the pressure chamber therebetween; and a damping layer formed to cover at least the upper portion of the piezoelectric actuator and an area of the fluid path forming substrate corresponding to a location of the pressure chamber to dampen a residual vibration of the piezoelectric actuator.

2. The piezoelectric inkjet printhead of claim 1, further comprising:

a printed circuit to apply a drive voltage to drive the piezoelectric actuator, wherein the damping layer is formed on a conjunction portion between the printed circuit and the piezoelectric actuator.

3. The piezoelectric inkjet printhead of claim 2, wherein a Young's modulus of the damping layer is smaller than a Young's modulus of the piezoelectric actuator and a mechanical loss rate of the fluid path forming substrate.

4. The piezoelectric inkjet printhead of claim 3, wherein the Young's modulus of the damping layer is not more than about 5,000 MPa.

5. The piezoelectric inkjet printhead of claim 4, wherein the damping layer is formed of a compound selected from the group consisting of silicone rubber, an epoxy, polyurethane, a photoresist substance, and combinations thereof.

6. The piezoelectric inkjet printhead of claim 3, wherein the damping layer is formed of a compound selected from the group consisting of silicone rubber, an epoxy, polyurethane, a photoresist substance, and combinations thereof.

* * * * *